US010668311B2

(12) United States Patent
Reimer

(10) Patent No.: US 10,668,311 B2
(45) Date of Patent: Jun. 2, 2020

(54) FIRE SUPPRESSANT INERT GAS GENERATOR

(71) Applicant: GOODRICH CORPORATION, Charlotte, NC (US)

(72) Inventor: Karl G Reimer, Fairfield, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 267 days.

(21) Appl. No.: 15/934,856

(22) Filed: Mar. 23, 2018

(65) Prior Publication Data

US 2019/0290952 A1 Sep. 26, 2019

(51) Int. Cl.

| | |
|---|---|
| ***A62D 1/06*** | (2006.01) |
| ***A62D 1/00*** | (2006.01) |
| ***A62C 5/00*** | (2006.01) |
| ***A62C 3/16*** | (2006.01) |

(52) U.S. Cl.

CPC ..... *A62D 1/06* (2013.01); *A62C 3/16* (2013.01); *A62C 5/006* (2013.01); *A62D 1/0092* (2013.01)

(58) Field of Classification Search

CPC ..... A62D 1/06

See application file for complete search history.

(56) References Cited

U.S. PATENT DOCUMENTS

| | | | | |
|---|---|---|---|---|
| 4,369,079 | A | 1/1983 | Shaw | |
| 4,370,181 | A | 1/1983 | Lundstrom et al. | |
| 5,467,715 | A | 11/1995 | Taylor et al. | |
| 5,609,210 | A | 3/1997 | Galbraith et al. | |
| 5,613,562 | A | 3/1997 | Galbraith et al. | |
| 5,765,866 | A | 6/1998 | Canterberry et al. | |
| 5,844,164 | A | 12/1998 | Cabrera | |
| 5,985,060 | A | 11/1999 | Cabrera et al. | |
| 6,004,411 | A | 12/1999 | Zeuner et al. | |
| 6,024,889 | A | 2/2000 | Holland et al. | |
| 6,045,637 | A | 4/2000 | Grzyll | |
| 6,120,058 | A | 9/2000 | Mangum et al. | |
| 6,217,788 | B1 | 4/2001 | Wucherer et al. | |
| 8,182,711 | B2 | 5/2012 | Posson et al. | |
| 8,613,821 | B2 | 12/2013 | Zhou | |
| 8,652,346 | B2 * | 2/2014 | Guo | A62D 1/0092 252/5 |
| 9,750,965 | B2 | 9/2017 | Marlin | |
| 9,861,845 | B2 | 1/2018 | Reimer | |
| 2002/0137875 | A1 | 9/2002 | Reed et al. | |
| 2011/0155943 | A1 * | 6/2011 | Posson | A62D 1/06 252/3 |
| 2016/0107012 | A1 * | 4/2016 | Reimer | A62D 1/06 169/46 |

FOREIGN PATENT DOCUMENTS

| | | |
|---|---|---|
| EP | 1316858 | 7/2010 |
| IL | 178810 | 7/2011 |

* cited by examiner

*Primary Examiner* — Peter F Godenschwager
(74) *Attorney, Agent, or Firm* — Snell & Wilmer LLP

(57) ABSTRACT

An inert gas-generating fire suppression composition is disclosed, consisting essentially of an oxidizer, comprising ammonium dinitramide and strontium nitrate, a fuel, comprising potassium isocyanurate, a gas-generate fuel, comprising guanidine nitrate and a quantity of carbon black.

16 Claims, 3 Drawing Sheets

FIRE SUPPRESSANT INERT GAS GENERATOR

FIELD

The present disclosure relates to fire suppressant compositions in general and, more specifically, to combustible fire suppressant inert gas generators.

BACKGROUND

Flame suppressants can be classified as either active (chemical) or passive (physical) suppressants. Active suppressants or suppression agents, also called "fire retardants," react chemically with and destroy free radicals in the flame. Free radicals are very short-lived species that catalyze flame reactions, and their chemical removal or modification in turn retards the flame. Passive suppressants, also called "fire suppressants," often seek to deprive the combusting fuel from oxygen by physically interfering with its transport or access to the flame combusting fuel.

One form of active suppressant is a class of materials sold as Halon™ which are composed of brominated or chlorinated fluorocarbon compounds, e.g., bromochlorodifluoromethane ($CF_2BrCl$) and trifluorobromomethane ($CF_3Br$). These and competitive materials exhibiting similar chemistry have been used effectively as fire suppression agents for years, typically to protect electrical equipment since there is very little residue to clean up. These fire suppression agents typically interrupt the chemical reaction that takes place when fuels burn and depend on a combination of chemical effectiveness, e.g., quenching of free radicals, and some physical effectiveness, e.g., cooling the combustion flame and dilution of the combustion ingredients. Certain halogen-containing fire suppression agents, however, such as $CF_3Br$, contribute to the destruction of stratospheric ozone. Although the materials are essentially nontoxic, passage through a flame or over hot surfaces can produces toxic fluorine compounds.

To reduce the environmental effects associated with halogenated fluorocarbons, many commercially available fire suppression agents designed today are passive, i.e., physically acting, agents. A passive suppressant does not react chemically with the flame. These fire suppression agents either blanket the burning material to deprive it of oxygen, dilute the oxygen in the environment to below the point that can sustain the flame, or cool the burning surface below its ignition temperature. Examples of physically-acting fire suppression agents include sodium bicarbonate and sand as well as inert gases, e.g., carbon dioxide ($CO_2$), water vapor ($H_2O$) and nitrogen ($N_2$). When applied to a fire, inert gases physically displace oxygen from the combustion region while simultaneously serving as a heat sink to reduce the temperature of the flame. The combination of the two physical actions results in suppression of the fire.

Physically-acting fire suppression agents are, however, also subject to certain issues and problems that can reduce their effectiveness at fire suppression. The agents typically require, for example, a large quantity of a physically-acting fire suppressant in order to suppress a fire and, consequently, equipment and storage must be correspondingly large to accommodate the required quantities. Such large equipment is a disadvantage in limited spaces and where additional equipment weight is an issue such as in aircraft and spacecraft. Another disadvantage of physical suppressants is they must often be applied directly to a combusting surface, which can inhibit their effectiveness against fires that are concealed or relatively inaccessible.

SUMMARY

An inert gas-generating fire suppression composition is disclosed. In various embodiments, the composition includes an oxidizer, comprising at least one of ammonium dinitramide and strontium nitrate; a fuel, comprising potassium isocyanurate; and a gas-generate fuel, comprising guanidine nitrate. In various embodiments, the composition further includes carbon black.

In various embodiments, the oxidizer is present in an amount from about 64% to about 77% by weight of a total weight of the composition. In various embodiments, the fuel is present in an amount from about 23% to about 36% by weight of a total weight of the composition. In various embodiments, the oxidizer is present in an amount from about 58% to about 65% ammonium dinitramide and from about 6% to about 12% strontium nitrate by weight of a total weight of the composition.

In various embodiments, the fuel is present in an amount from about 18% to about 24% potassium isocyanurate by weight of a total weight of the composition. In various embodiments, the gas-generate fuel is present in an amount from about 4% to about 8% guanidine nitrate by weight of a total weight of the composition.

In various embodiments, the oxidizer is present in an amount from about 58% to about 65% ammonium dinitramide and from about 6% to about 12% strontium nitrate by weight of a total weight of the composition and the fuel is present in an amount from about 18% to about 24% potassium isocyanurate by weight of the total weight of the composition. In various embodiments, the gas-generate fuel is present in an amount from about 4% to about 8% guanidine nitrate by weight of the total weight of the composition. In various embodiments, the composition further includes carbon black in an amount from about 1% to about 4% by weight of the total weight of the composition.

In various embodiments, the oxidizer is present in an amount from about 58% to about 65% ammonium dinitramide and from about 6% to about 12% strontium nitrate by weight of a total weight of the composition, the fuel is present in an amount from about 18% to about 24% potassium isocyanurate by weight of the total weight of the composition, the gas-generate fuel is present in an amount from about 4% to about 8% guanidine nitrate by weight of the total weight of the composition and the carbon black is present in an amount from about 1% to about 4% by weight of the total weight of the composition.

In various embodiments, the oxidizer is present in an amount equal to about 61.0% ammonium dinitramide and about 8.5% strontium nitrate by weight of a total weight of the composition, the fuel is present in an amount equal to about 21.5% potassium isocyanurate by weight of the total weight of the composition, the gas-generate fuel is present in an amount equal to about 6% guanidine nitrate by weight of the total weight of the composition and the carbon black is present in an amount equal to about 3% of the total weight of the composition. In various embodiments, a set of combustion products resulting from combustion of the composition comprise about 40% nitrogen, about 36% water vapor and about 21% carbon dioxide by a total weight of the combustion products.

An inert gas-generating fire suppression composition is disclosed. In various embodiments, the composition includes an oxidizer, comprising at least one of ammonium dinitramide and strontium nitrate; a fuel comprising potassium isocyanurate; and a gas-generate fuel component comprising from about 3% to about 9% of a total weight of the composition, where the gas-generate fuel component is selected from a group consisting of 5-aminotetrazole, bitetrazole, guanidine bitetrazole, guanyl aminotetrazole nitrate, and guanidine nitrate.

In various embodiments, the oxidizer is present in an amount from about 64% to about 77% by weight of the total weight of the composition. In various embodiments, the fuel is present in an amount from about 23% to about 36% by weight of the total weight of the composition. In various embodiments, the oxidizer is present in an amount from about 58% to about 65% ammonium dinitramide and from about 6% to about 12% strontium nitrate by weight of the total weight of the composition.

In various embodiments, the oxidizer is present in an amount from about 58% to about 65% ammonium dinitramide and from about 6% to about 12% strontium nitrate by weight of the total weight of the composition, the fuel is present in an amount from about 18% to about 24% potassium isocyanurate by weight of the total weight of the composition, the gas-generate fuel component is present in an amount from about 4% to about 8% guanidine nitrate by weight of the total weight of the composition.

In various embodiments, the composition further includes carbon black, the oxidizer is present in an amount equal to about 61.0% ammonium dinitramide and equal to about 8.5% strontium nitrate by weight of a total weight of the composition, the fuel is present in an amount equal to about 21.5% potassium isocyanurate by weight of the total weight of the composition, the gas-generate fuel component is present in an amount equal to about 6% guanidine nitrate by weight of the total weight of the composition and the carbon black is present in an amount equal to about 3% of the total weight of the composition. In various embodiments, a set of combustion products resulting from combustion of the composition comprise about 40% nitrogen, about 36% water vapor and about 21% carbon dioxide by a total weight of the combustion products.

BRIEF DESCRIPTION OF THE DRAWING

The subject matter of the present disclosure is particularly pointed out and distinctly claimed in the concluding portion of the specification. A more complete understanding of the present disclosure, however, may best be obtained by referring to the following detailed description and claims in connection with the following drawing. While the drawing illustrates various embodiments employing the principles described herein, the drawing does not limit the scope of the claims.

DETAILED DESCRIPTION

Figure 1:
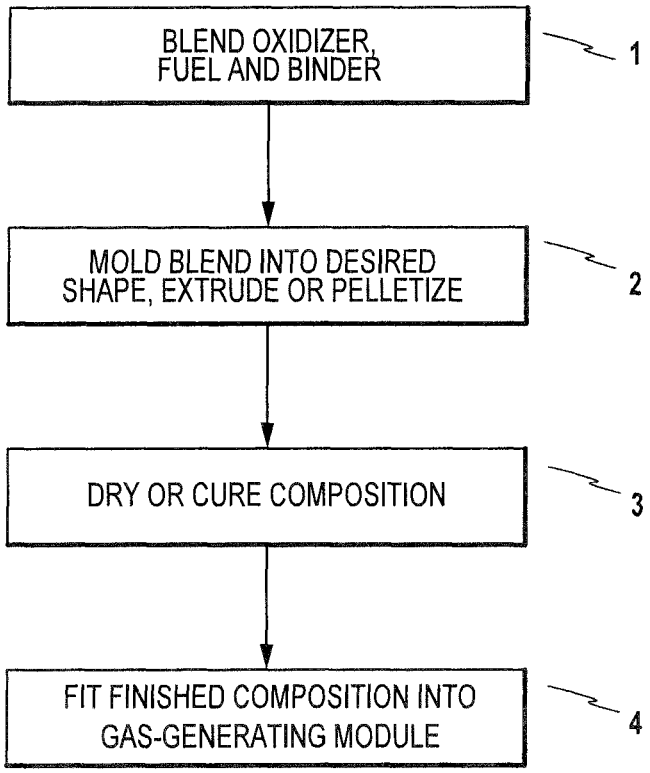
FIG. 1 illustrates a series of steps used in preparing an inert gas-generating composition and module, in accordance with various embodiments.

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

The following disclosure provides a composition or formulation that, when ignited, combusts to generate a fire suppressing inert gas. As used herein, an inert gas is considered a gas that does not chemically interact with an ongoing combustion process under typical combustion conditions. Examples of inert gases include, for example, $N_2$, $CO_2$, $H_2O$, Ar, He and the like, as compared to non-inert gases, which include, for example, $O_2$, $H_2$, $CH_4$ and the like. The range of individual components in the disclosed composition or formulation may be varied to provide desirable burn temperatures, gas yields and other properties required for particular applications. Thus, the specific examples of the fire suppressing gas generator composition disclosed herein should not be considered limiting.

The inert gas generator composition disclosed herein, in general terms, comprises a high nitrogen content solid used in conjunction with three solid fuels and two solid oxidizers in an amount sufficient to cause flameless deflagration of the fuel and thermal decomposition of the nitrogen-rich solid. In various embodiments, the inert gas generator composition comprises potassium isocyanurate ($KN_3O_3H_2$), guanidine nitrate ($CH_6N_4O_3$) and carbon black (C), as a fuel or components thereof and strontium nitrate ($Sr(NO_3)_2$) and ammonium dinitramide ($H_4N_4O_4$) as oxidizers. In various embodiments, the composition burns relatively cool—approximately 1,400 K at atmospheric pressure—and generates a high output of inert, flame suppressing gases (e.g., $CO_2$, $H_2O$ and $N_2$) that are both inert, non-toxic and non-corrosive, with substantially no residual ash or sludge. In various embodiments, the rate of combustion can be altered by varying the amount of a coolant ingredient or the fuel composition. The flame suppressing inert gas generator composition and variants thereof is described in further detail below.

Oxidizer Components

In various embodiments, the oxidizer is present in the inert gas generator composition in an amount of about 60 wt. % to about 80 wt. % based on the total weight of the composition (unless stated otherwise, all weight percent values herein are based on the total weight of the composition). In various embodiments, the oxidizer is present in the composition in an amount of about 64 wt. % to about 77 wt. %, and even more specifically from about 68 wt. % to about 71 wt. %.

Examples of oxidizers used in the inert gas generator composition include lithium nitrate, sodium nitrate, potassium nitrate, aluminum nitrate, lithium chlorate, sodium chlorate, potassium chlorate, lithium bromate, sodium bromate, potassium bromate, lithium iodate, sodium iodate, potassium iodate, aluminum iodate, lithium perchlorate, sodium perchlorate, potassium perchlorate, aluminum perchlorate, lithium periodate, sodium periodate, potassium periodate, aluminum periodate, lithium chlorite, sodium chlorite, potassium chlorite, aluminum chlorite, lithium bromite, sodium bromite, strontium nitrate, ammonium dinitramide or mixtures thereof. In various embodiments, the oxidizers are selected from sodium bromate, potassium bromate, ammonium nitrate, potassium nitrate, sodium nitrate, strontium nitrate, ammonium dinitramide or mixtures thereof. In various embodiments, the oxidizers are strontium nitrate and ammonium dinitramide. Mixtures of these oxidizers can be used to control the rate of burning. For example, oxamid, potassium nitrate or sodium nitrate may be substituted for a portion of strontium nitrate or ammonium dinitramide to decrease the rate of burning, as well as cost.

Fuel Components

The fuel components include, but are not limited to, melamine cyanurate, cyanuric acid, salts of cyanuric acid, isocyanuric acid, barbituric acid, hydroxyacetic acid, potassium isocyanurate or mixtures thereof. Other fuel components like carbon black and or graphite can also be included. The fuel components may also be a salt of other organic acids, including salts of hydroxy alkanedioic acids of a $C_{3-7}$ alkane, e.g., tartaric acid. Organic salts used as fuel in the compositions can be Group IA or Group IIA salts. Thus, examples of organic salts used in the compositions include, but are not limited to, lithium cyanurate, sodium cyanurate, potassium cyanurate, magnesium cyanurate, lithium isocyanurate, sodium cyanurate, potassium cyanurate, magnesium cyanurate, lithium barbiturate, sodium barbiturate, potassium barbiturate, magnesium barbiturate, lithium hydroxyacetate, sodium hydroxyacetate, potassium hydroxyacetate, magnesium hydroxyacetate, lithium tartrate, sodium tartrate, potassium tartrate, magnesium tartrate, or mixtures thereof. In various embodiments, the organic salt comprises potassium cyanurate, magnesium cyanurate, potassium tartrate, magnesium tartrate, or mixtures thereof.

In various embodiments, the fuels are present in the composition in an amount of about 20 wt. % to about 40 wt. % based on the total weight of the gas-generating composition. In some more specific embodiments, the fuels are present in the composition in an amount of about 23 wt. % to about 36 wt. %, and even more specifically from about 28 wt. % to about 32 wt. %. Compositions comprising a 1:1 weight ratio of oxidizer to fuel component, such as, for example, potassium bromate and magnesium tartrate, burn rapidly, but produce considerable residue. It has been discovered that compositions comprising a higher weight amount of oxidizer compared to the organic salt component burn rapidly and cleaner, with a lower amount of inorganic residue. In various embodiments, the oxidizer is present in a greater amount than the fuel. Accordingly, the weight ratio of oxidizer to fuel can be greater than about 1:1, allowing for a cleaner burning composition. In some embodiments, the weight ratio of oxidizer to fuel is from about 3:2 to about 3:1. In some embodiments, the weight ratio of the oxidizer to the fuel is about 7:3 (or about 70% oxidizer to about 30% fuel).

Gas Generator Fuel Components

Gas generator fuel components that are particularly useful for the present compositions produce large amounts of inert gases, such as, e.g., carbon dioxide ($CO_2$), water vapor ($H_2O$) and nitrogen ($N_2$) upon thermal decomposition or upon chemical reduction in the presence of an oxidizer. In various embodiments, the gas generator fuel components include nitrogen-rich compounds that are capable of thermal decomposition without playing a substantial role in the reduction-oxidation reaction of the fuel and oxidizer components. Examples of nitrogen rich compounds include 5-aminotetrazole ($CH_3N_5$), bitetrazole ($C_2H_2N_8$), guanidine bitetrazole, guanyl aminotetrazole nitrate, and guanidine nitrate ($CH_6N_4O_3$). In various embodiments, guanidine nitrate is used as a gas generator fuel component because it tends to thermally decompose without substantial involvement with the reduction-oxidation reaction of the fuel and oxidizer components.

Binder

The gas-generating compositions disclosed herein may further include a binder or binder system. The binder systems encompassed by the present invention should be chemically stable at storage temperatures, so that no reaction between the fuel or oxidizer components and the binder system will occur prior to use. Thus, the binder chosen for the binder system may include a resin having a low flame temperature and heat of formation. The binder can, in some cases, also function as a fuel component, and some fuels (e.g., melamine) can become part of the binder by reacting into the binder matrix during cure.

In various embodiments, suitable binders include, but are not limited to, silicates, including alkali silicates, cellulose derivatives, cellulose ethers, alginic binders, gums, gels, clays, pectins, starches, polyvinyl compounds or mixtures thereof. In various embodiments, the binders include, but are not limited to, hydrolyzed ethyl silicate, sodium silicate, potassium silicate, plasticized polyvinyl alcohol, polyvinyl butyral, polyvinyl acetate, cellulose derivatives, such as nitro cellulose, hydroxyethylethyl cellulose, hydroxypropyl cellulose, hydroxymethylethyl cellulose, sodium carboxymethyl cellulose, methyl cellulose, hydroxyethyl cellulose, hydroxypropyl cellulose, glycerine, polyvinyl pyrrolidone, ammonium alginate, sodium alginate, potassium alginate, magnesium alginate, triethanolamine alginate, propylene glycol alginate, gum Arabic, gum ghatti, gum tragacanth, Karaya gum, locust bean gum, acacia gum, guar gum, quince see gum, xanthan gum, agar, agarose, caragenneans, fucoidan, furecelleran or mixtures thereof. In various embodiments, the binders include, but are not limited to, carboxy-terminated polybutadiene (CTPB), polyethylene glycol (PEG), polypropylene glycol (PPG), hydroxy-terminated polybutadiene (HTPB), polybutadiene acrylonitrile (PBAN), polybutadiene acrylic acid (PBAA), butacene (HTPB iron adduct), glycidyl azide polymer (GAP), polyglycol adipate (PGA), or other thermoplastic polymers, such as, but not limited to, polystyrene, polycarbonate and polyvinylchloride, as well as compatible mixtures of any of the foregoing thereof. In various embodiments, the binders include silica, including silicon dioxide, ceramic materials or unplasticized materials or polymers, such as unplasticized polyvinylchloride.

The binder, when used, can be present in an amount from about 0.5 weight percent to about 20 weight percent of the composition. In various embodiments, the binder is present in an amount from about 1 weight percent to about 15 weight percent of the composition. In various embodiments, the binder is present in an amount from about 2 weight percent to about 10 weight percent of the composition. Polyols may be added in addition to the binder to plasticize the binder material and increase the dry strength of the product. Examples of such polyols include, but are not limited to, glycerol and glycols, such as propylene glycol or polyethylene glycol. In various embodiments, the polyols are present in an amount from about 0.5 weight percent to about 20 weight percent of the composition. In various embodiments, the polyol is present in an amount from about 4 weight percent to about 15 weight percent of the composition. In various embodiments, the polyol is present in an amount from about 8 weight percent to about 12 weight percent of the composition. In various embodiments, the polyol is present in an amount from about 2 weight percent to about 6 weight percent of the composition.

In various embodiments, the binder system is organic in nature and includes at least a binder or binder resin and a plasticizer. The binder system can be in a solid form at a temperature below 100° C. The binder resin may include at least one of a curable binder, melt cast binder or solvated binder or a mixture thereof. The binder system may also include one or more of a curing or bonding agent, an antioxidant, an opacifier, or a halogen scavenger such as lithium carbonate. Curing agents suitable for use with the disclosure may include hexamethylene diisocyanate (HMDI), isophorone diisocyanate (IPDI), toluene diisocyanate (TDI), trimethylxylene diisocyanate (TMDI), dimeryl diisocyanate (DDI), diphenylmethane diisocyanate (MDI), naphthalene diisocyanate (NDI), dianisidine diisocyanate (DADI), phenylene diisocyanate (PDI), xylene diisocyanate (MXDI), other diisocyanates, triisocyanates, higher isocyanates than the triisocyanates, polyfunctional isocyanates or a mixture thereof. The amount of the curing agent used is generally determined by the desired stoichiometry between the curable binder and the curing agent. The curing agent is typically present in an amount of up to about 5 percent. However, if a curable binder is used, the curing agent is present from about 0.5 percent to about 5 percent.

Other Additives

Other additives can be included as well, as known in the art, including but not limited to cure catalysts (e.g., butyl tin dilaurate, a metal acetylacetonate), antioxidants (e.g., 2,2'-bis(4-methyl-6-t-butylphenol)), corrosion inhibitors and extrusion lubricants. An opacifier such as carbon black can aid in providing uniform heat transfer and reducing possible areas of select heat build-up. It also functions as a UV obscurant to help mitigate radiant UV transmission emitting from the burn front into the unburned composition. Exemplary levels for opacifiers can range from about 0.01 wt. % to about 2 wt. % based on the total solids of the combustible composition. Graphite may be included to eliminate any ESD (electrostatic discharge) build up to prevent any auto-ignition. Exemplary levels for graphite can range from about 0.01 wt. % to about 5 wt. % based on the total solids of the combustible composition.

Preparation

Referring to FIG. 1, a series of steps that may be employed in preparing an inert gas-generating composition and module, according to various embodiments, is illustrated. The combustible flame suppressant gas-generating composition can be prepared by blending the above-described components, e.g., oxidizer, fuel, binder or components thereof (e.g., polyfunctional resin and polyfunctional curing agent) and any additional or optional components in a mixing vessel (Box 1). During the working time of the composition, the mixture can be molded into a desired shape or extruded and pelletized (Box 2). The presence in the composition of materials that will release moisture at relatively low temperatures, e.g., below 180° C., can cause the composition to burn poorly or inconsistently or not function at all, particularly at temperature extremes (e.g., below −40° F. and above 160° F.). Accordingly, in various embodiments, such materials that can retain water and release it at temperatures below 180° C. (e.g., potassium cyanurate and bromate) are dried such as by heating to temperatures of 180° C. (Box 3).

Figure 2:
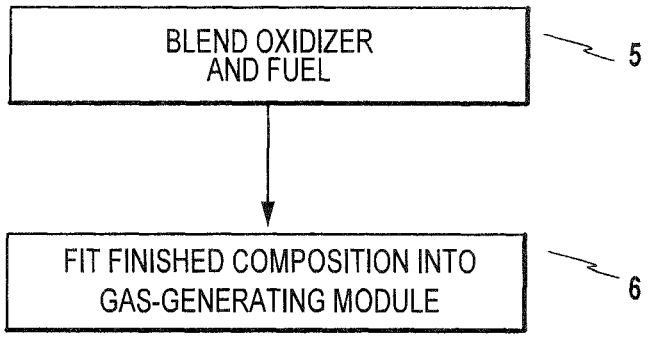
FIG. 2 illustrates a series of steps used in preparing an inert gas-generating composition and module, in accordance with various embodiments.

In various embodiments, particle sizes of the various ingredients before blending are selected to help contribute to beneficial burn rate profiles and other characteristics. Exemplary particle sizes for the oxidizer (e.g., ammonium dinitramide or strontium nitrate) and fuel (e.g., potassium isocyanurate) can range from 1 μm to 100 μm, more specifically from 1 μm to 50 μm, and even more specifically from 1 μm to 30 μm. After cure, the composition is complete, the solid combustible gas-generating composition can be fitted into a gas-generating module, either in powder form or as compressed pellets (Box 4). In various embodiments, as illustrated in FIG. 2, the combustible flame suppressant gas-generating composition can be prepared by blending the fuel and the oxidizer, without a binder, and any additional or optional components in a mixing vessel (Box 5) and the resulting composition, generally in mixed powder form, is placed into a gas-generating module (Box 6).

Figure 3:
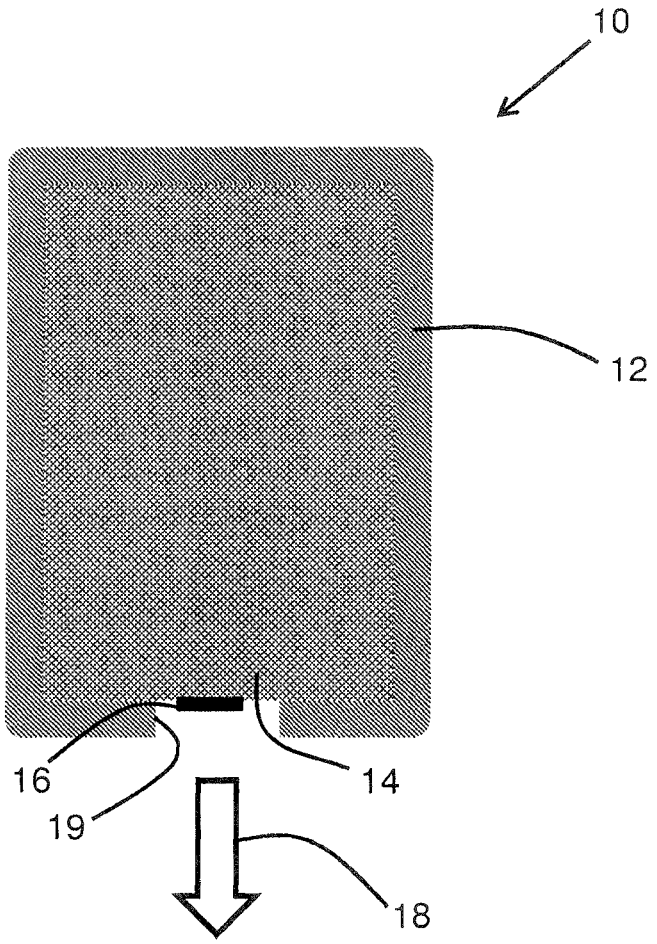
FIG. 3 is a schematic depiction of an inert gas-generating module, in accordance with various embodiments.

An exemplary module is schematically depicted in FIG. 3, where an inert gas-generating module 10 has a module housing or vessel 12 with a solid gas-generating composition or pyrotechnic grain 14 therein. Upon activation of combustion by an ignition source or device 16 (e.g., an electronic ignition device), combustion of the solid gas-generating composition 14 produces a flow of inert combustion gases 18 that are exhausted as a gas through an inert gas exit orifice or opening 19.

The gas-generating fire suppression compositions have other uses as well, including, but not limited to, smoke grenades, colored signal devices, smoke tracers, agent dispersal compositions and air current tracer devices of low incendiary potential. Also, inert gas generator compositions may be used for inflating bags such as in automotive safety air bags, life rafts, and aircraft emergency escape slides. The dense, opaque, nontoxic smoke produced, which is transparent to infrared vision devices, provides for utility in crowd control or hostage situations encountered by law enforcement. In addition, the gas-generating fire suppression compositions may also be used as an expulsion charge for items, such as infrared flares and other types of flares. The low reaction temperatures and lack of flash can aid in concealing the combustion source from observation. Further, the compositions of the present disclosure may be used in finely granulated form to generate gas to fill air bags, particularly where low temperatures are required to avoid damage to the air bag itself.

The inert gas generator compositions are further described in the following Examples set forth below.

Example 1

An oxidizer comprising about 61 grams of ammonium dinitramide and 8.5 grams of strontium nitrate is prepared by reducing particle size, as necessary, to between 1μ and 30μ using a ball jar mill/burundum apparatus or equivalent. The two-component oxidizer is then mixed with a fuel component comprising about 21.5 grams of potassium isocyanurate and a gas-generate fuel component comprising about 6 grams of guanidine nitrate. About 3 grams of carbon black is further mixed with the two-component oxidizer, the fuel component and the gas-generator component described above to form a homogenous mixture. In various embodiments, the mix is performed with the addition of an inert solvent such as isopropyl alcohol (IPA). After the mix is complete the IPA is evaporated off and the material is then screened to the desired particle size. The resulting homogenous mixture can be used directly as is or combined with a binder, such as a silica binder, a silicate binder or ceramic binder and compressed into a vessel for use as a pyrotechnic gas-generating fire suppressant. In some cases the binder may be added at the beginning of the initial mix. Alternatively, the resulting homogeneous mixture may be combined with a binder and pressed into pellets, with the pellets then loaded into the vessel.

Using the PEP thermochemical analytical code, properties for the above composition (without binder) were determined. For a theoretical burn using ProPEP, the composition provided a total of 3.32 moles of exhaust gas per one-hundred (100) grams of the composition, the exhaust gas containing substantially all inert gases as follows: 40% nitrogen, 36% water vapor and 21% carbon dioxide. The data from these calculations are shown in more detail below.

| Combustion Components | Moles Generated | Component Phase | % of Total Output | % of Gas Output |
|---|---|---|---|---|
| $N_2$ | 1.314 | gas | 39.07 | 39.58 |
| $H_2O$ | 1.197 | gas | 35.59 | 36.05 |
| $CO_2$ | 0.686 | gas | 20.40 | 20.66 |
| KHO | 0.123 | gas | 3.66 | 3.71 |
| SrO | 0.040 | condensed | 1.19 | n/a |
| $K_2CO_3$ | 0.002 | condensed | <0.01 | n/a |
| Other minor | 0.001 | condensed/gas | <0.001 | trace |

Example 2

A slurry is formed by combining about 100 grams of the final composition prepared in Example 1 and about 2 to 4 grams of a thermoplastic polymer such as polysulfone using an appropriate anhydrous solvent such as cyclohexanone. Once mixed homogenously the composition is placed in a dismountable mold or discharge vessel, allowing the solvent to completely evaporate, thereby having the hardened composition available for use as a pyrotechnic gas-generating fire suppressant.

While the disclosure has been described in detail in connection with only a limited number of embodiments, it should be readily understood that the scope of the disclosure is not limited to the disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments have been described, it is to be understood that various other aspects of the disclosure may include only some of the described embodiments. Accordingly, the disclosure is not to be seen as limited by the foregoing embodiments, but is only limited by the scope of the appended claims.

What is claimed is:

1. An inert gas-generating fire suppression composition, comprising:

an oxidizer, comprising ammonium dinitramide and strontium nitrate;

a fuel, comprising potassium isocyanurate; and a gas-generate fuel, comprising guanidine nitrate, wherein the oxidizer is present in an amount from about 58% to about 65% ammonium dinitramide and from about 6% to about 12% strontium nitrate by weight of the total weight of the composition.

2. The composition of claim 1, further comprising carbon black.

3. The composition of claim 2, wherein the fuel is present in an amount from about 18% to about 24% potassium isocyanurate by weight of the total weight of the composition, the gas-generate fuel is present in an amount from about 4% to about 8% guanidine nitrate by weight of the total weight of the composition and the carbon black is present in an amount from about 1% to about 4% by weight of the total weight of the composition.

4. The composition of claim 3, wherein the oxidizer is present in an amount equal to about 61.0% ammonium dinitramide and about 8.5% strontium nitrate by weight of a total weight of the composition, the fuel is present in an amount equal to about 21.5% potassium isocyanurate by weight of the total weight of the composition, the gas-generate fuel is present in an amount equal to about 6% guanidine nitrate by weight of the total weight of the composition and the carbon black is present in an amount equal to about 3% of the total weight of the composition.

5. The composition of claim 2, wherein a set of combustion products resulting from combustion of the composition comprise about 40% nitrogen, about 36% water vapor and about 21% carbon dioxide by a total weight of the combustion products.

6. The composition of claim 1, wherein the fuel is present in an amount from about 23% to about 36% by weight of a total weight of the composition.

7. The composition of claim 1, wherein the fuel is present in an amount from about 18% to about 24% potassium isocyanurate by weight of a total weight of the composition.

8. The composition of claim 1, wherein the gas-generate fuel is present in an amount from about 4% to about 8% guanidine nitrate by weight of a total weight of the composition.

9. The composition of claim 1, wherein the fuel is present in an amount from about 18% to about 24% potassium isocyanurate by weight of the total weight of the composition.

10. The composition of claim 9, wherein the gas-generate fuel is present in an amount from about 4% to about 8% guanidine nitrate by weight of the total weight of the composition.

11. The composition of claim 10, further comprising carbon black in an amount from about 1% to about 4% by weight of the total weight of the composition.

12. An inert gas-generating fire suppression composition, comprising:

an oxidizer, comprising ammonium dinitramide and strontium nitrate;

a fuel, comprising potassium isocyanurate; and a gas-generate fuel comprising from about 3% to about 9% of a total weight of the composition, wherein the gas-generate fuel component is selected from the group consisting of 5-aminotetrazole, bitetrazole, guanidine bitetrazole, guanyl aminotetrazole nitrate, and guanidine nitrate, wherein the oxidizer is present in an amount from about 58% to about 65% ammonium dinitramide and from about 6% to about 12% strontium nitrate by weight of the total weight of the composition.

13. The composition of claim 12, wherein the fuel is present in an amount from about 23% to about 36% by weight of the total weight of the composition.

14. The composition of claim 12, wherein the fuel is present in an amount from about 18% to about 24% potassium isocyanurate by weight of the total weight of the composition, the gas-generate fuel component is present in an amount from about 4% to about 8% guanidine nitrate by weight of the total weight of the composition.

15. The composition of claim 12, further comprising carbon black and wherein the oxidizer is present in an amount equal to about 61.0% ammonium dinitramide and equal to about 8.5% strontium nitrate by weight of a total weight of the composition, the fuel is present in an amount equal to about 21.5% potassium isocyanurate by weight of the total weight of the composition, the gas-generate fuel component is present in an amount equal to about 6% guanidine nitrate by weight of the total weight of the composition and the carbon black is present in an amount equal to about 3% of the total weight of the composition.

16. The composition of claim 15, wherein a set of combustion products resulting from combustion of the composition comprise about 40% nitrogen, about 36% water vapor and about 21% carbon dioxide by a total weight of the combustion products.

* * * * *